US005316089A

United States Patent [19]

Fernandez

[11] Patent Number: 5,316,089

[45] Date of Patent: May 31, 1994

[54] METHOD AND APPARATUS FOR DRILLING A SUBSEA WELL

[75] Inventor: Randolfo M. Fernandez, Aberdeen, Scotland

[73] Assignee: ABB Vetco Gray Inc., Houston, Tex.

[21] Appl. No.: 781,054

[22] Filed: Oct. 18, 1991

[51] Int. Cl.[5] ..... E21B 7/128

[52] U.S. Cl. ..... 175/7; 166/339; 166/342; 166/349; 166/358; 166/365

[58] Field of Search ..... 175/7; 166/339, 342, 166/348, 349, 358, 365

[56] References Cited

U.S. PATENT DOCUMENTS

| | | | |
|---|---|---|---|
| 3,177,954 | 4/1965 | Rand | 175/7 |
| 3,788,396 | 1/1974 | Shatto, Jr. et al. . | |
| 4,553,600 | 11/1985 | Vigouroux et al. | 166/343 |
| 4,611,661 | 9/1986 | Hed et al. | 166/339 |
| 4,673,041 | 6/1987 | Turner et al. | 166/340 |
| 4,797,029 | 1/1989 | Cowan et al. | 405/170 |
| 4,813,496 | 3/1989 | Rohweller et al. | 175/7 |
| 4,877,088 | 10/1989 | Rodrignes et al. | 166/342 |
| 5,088,556 | 2/1992 | Short et al. | 166/339 |

*Primary Examiner*—Hoang C. Dang
*Attorney, Agent, or Firm*—James E. Bradley

[57] ABSTRACT

A method of drilling a subsea well involves partial drilling of several wells within a cluster. A base such as a template will have a receptacle. A gimbal mounts to a latching mechanism which in turn releasably latches an outer wellhead housing. The latching mechanism has an upward facing guide funnel. After setting conductor pipe, the well is drilled to a selected depth, an inner wellhead housing and a first string of casing are lowered through the funnel. The running tool for the inner wellhead housing has a funnel retriever which latches to the funnel. After the casing has been cemented, upward movement of the running tool will pull the funnel, latching mechanism and gimbal to the surface.

19 Claims, 2 Drawing Sheets

METHOD AND APPARATUS FOR DRILLING A SUBSEA WELL

BACKGROUND OF THE INVENTION

1. Field of the Invention

This invention relates in general to subsea wellhead equipment, and in particular to a method and apparatus for batch drilling several wells within a cluster to a selected depth for subsequent completion.

2. Description of the Prior Art

In one subsea drilling technique, a template will be located on the sea floor. The template will have a number of receptacles through which a well will be drilled. Using a floating drilling vessel, the operator may drill each well, cap it, then move to another. At a later date, a platform will be installed over the template. The operator will then tie-back the wells to the platform, run production tubing, and install a surface tree at the platform.

In this technique, a gimbal is mounted to a conductor or conductor housing, which is then lowered onto the receptacle of the template. The gimbal lands on a cone facing upward from the template receptacle. The gimbal allows vertical alignment of the wellhead housing and conductor if the template is oriented other than precisely horizontal, as well as temporary support of the conductor while cement sets.

Normally, the gimbal is mounted to the bottom of a guide base. The operator lowers large diameter conductor pipe into the sea, with an outer or low pressure wellhead housing located at the upper end and with the guide base latched around the outer wellhead housing. The gimbal lands on the cone of the receptacle. The outer wellhead housing or conductor latches into the receptacle. Once the conductor pipe is in place, the well is drilled to a greater depth with a drill bit of a smaller diameter.

Then, the operator will lower a first string of casing through the conductor pipe, with the string having an inner or high pressure wellhead housing located at its upper end. The inner wellhead housing lands in the conductor housing or outer wellhead housing. The operator will cement this string of casing in place.

The operator may then lower a blowout preventer stack onto the inner wellhead housing. The guide base serves to orient the blowout preventer stack. The operator will then drill the well to total depth and install a second string of casing. The operator may then withdraw the guide base and install a corrosion cap to cover and protect the well. Subsequently, the operator will remove the cap once the platform is in place for tieback and completing the well for production. The operator uses guidelines extending from the template and guide base to the drilling vessel for the various operations.

In some cases it is important that no significant weight be transferred to the template. The template may not be structurally strong enough to support all the casing from all the wells, or it may be located on a soft sea bed and may incline or move under weight. Landing the blowout preventer stack and the second string of casing in the inner wellhead housing could transfer substantial weight to the template through the gimbal. The operator may eliminate the gimbal in such a case, either from the beginning or after the first string of casing has been installed. However, this requires the operator to retrieve the guide base and gimbal on a separate trip after installing the first string of casing. He would have to remove the gimbal from the guide base and lower the guide base back in place. This is time consuming in deep water. Alternately, the operator may utilize a larger template, but this is expensive.

While workable, the use of a guide base for installing the inner and outer wellhead housings is cumbersome because of the size of the guide base. Also, removing the gimbal requires an additional trip. Using guidelines is troublesome at times. Systems have been employed utilizing upward facing funnels mounted permanently to the outer wellhead housing rather than using guidelines. These funnels are large and expensive. They can also interfere with certain operations.

SUMMARY OF THE INVENTION

In this invention, the gimbal is secured to a latching mechanism which latches to the outer or conductor wellhead housing. A funnel secures to the upper end of the latching mechanism. A guide base is not used to run the inner and outer wellhead housings.

The funnel guides the drill bit as well as the first string of casing and the inner wellhead housing into the outer wellhead housing. Once the inner wellhead housing has been run, the latch is released by a retrieving tool mounted to the running tool of the inner wellhead housing. When the latch is released, the retrieving tool will also retrieve the funnel and the gimbal.

The well may be capped at that point. Then once all of the wells within a cluster have been installed with the first string of casing, the operator may enter each well with a blowout preventer stack for completing the well to total depth. At that point, the operator may use a funnel down guidelineless reentry system to connect the blowout preventer stack.

DETAILED DESCRIPTION OF THE INVENTION

Figure 1:
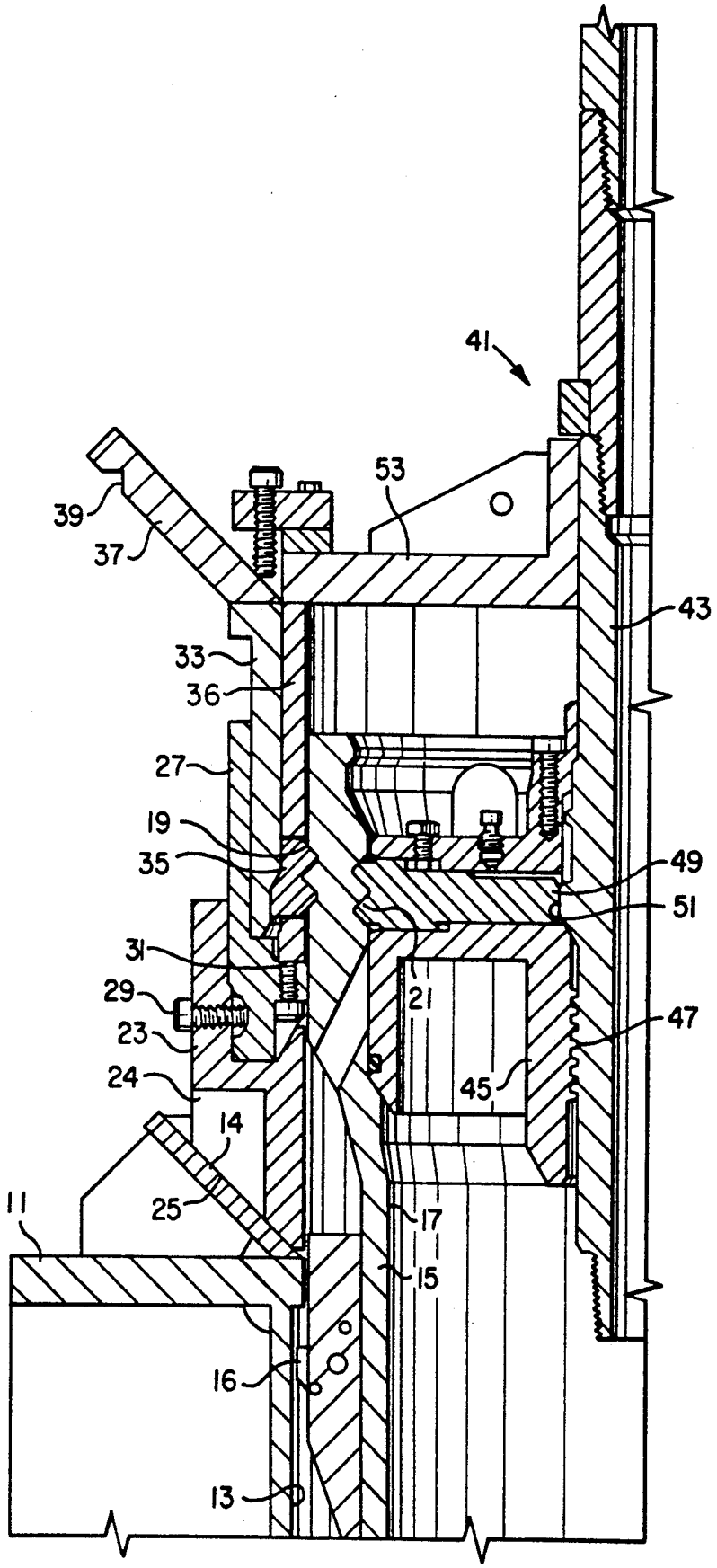
FIG. 1 is a partial quarter sectional view illustrating a subsea wellhead operation in accordance with this invention, showing the outer wellhead housing being installed.

Referring to FIG. 1, template 11 is a base structure located on a subsea floor for a cluster of wells. Template 11 has a plurality of receptacles 13 (only one shown). Each receptacle 13 has on its upper end a conical upward facing flange 14.

An outer or low pressure wellhead housing 15 is shown in FIG. 1 located into place. The lower end of outer wellhead housing 15 is secured to large diameter conductor pipe (not shown), normally 30 inches in diameter. There may be 500 to 1000 feet of conductor pipe. Typically a hole is drilled and the conductor pipe run in, set, and cemented in place. A latch 16 on the exterior of the outer wellhead housing 15 latches the outer wellhead housing 15 to the receptacle 13.

Outer wellhead housing 15 has an axial passage or bore 17 extending through it. A pair of external circumferential grooves 19 are located on the exterior of the outer wellhead housing 15 above the conical flange 14. The wellhead housing 15 has a pair of internal grooves 21 within bore 17.

A gimbal 23 lands on top of conical flange 14. Gimbal 23 typically has a plurality of vertical webs 24 that extend downward. Webs 24 are spaced circumferentially around the gimbal 23. Each web 24 has an inclined lower surface 25 that mates with the conical flange 14. The lower surfaces 25 define a conical contour. The movement of gimbal 23 relative to cone 14 allows some skewing movement relative to the axis of receptacle 13 so as to assure that the outer wellhead housing 15 is truly vertical. The gimbal 23 also provides conductor hang off onto the receptacle cone 25.

Gimbal 23 is secured to a tubular member 27 by a plurality of fasteners 29. Tubular member 27 extends upward to a point above the external grooves 19 of the outer wellhead housing 15. A sleeve 33 slides axially within the inner diameter of tubular member 27. Sleeve 33 extends upward above the tubular member 27. A stop (not shown) allows sleeve 33 to move between upper and lower positions relative to tubular member 27, but retains sleeve 33 with the tubular member 27. The stop could comprise bolts secured to tubular member 27 and extending radially through vertical slots formed in sleeve 33.

Figure 2:
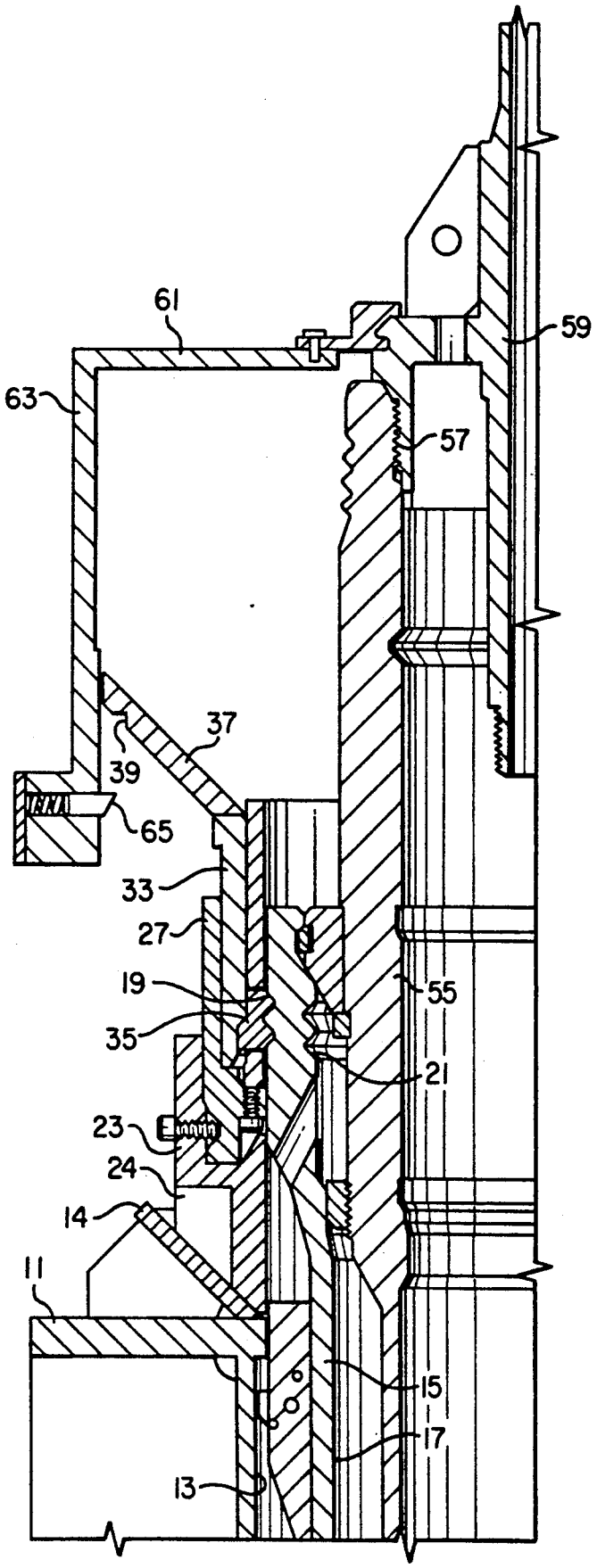
FIG. 2 is a partial quarter sectional view of the subsea wellhead of FIG. 1, showing the inner wellhead housing being installed.

Sleeve 33 when in the lower position shown in FIGS. 1 and 2, will force a plurality of dogs 35 inward into engagement with the external grooves 19 of outer wellhead housing 15. Dogs 35 are each carried within a window of a sleeve 36, and serve as a locking member. Fasteners 31 extend vertically through part of the tubular member 27 and support the lower end of the dogs 35 to position the dogs 35 for engagement with the grooves 19. The tubular member 27, sleeves 33, 36 and dogs 35 make up a latch member for latching the gimbal 23 to the outer wellhead housing 15.

A funnel 37 is bolted or otherwise secured to the upper end of sleeve 33. Funnel 37 is a conical member that faces upward. An annular groove or recess 39 locates on the lower surface of funnel 37. Funnel 37 moves in unison with sleeve 33.

A running tool 41 is shown installing the outer wellhead housing 15. In this embodiment, running tool 41 is conventional. Running tool 41 is preferably is a drill ahead type tool. That is, it is used not only to run the outer wellhead housing 15, but is also used for drilling the well to a greater depth after the conductor pipe is installed. One drill ahead type tool is shown in U.S. Pat. No. 4,813,496, Rohweller, et al, Mar. 31, 1989. Running tool 41 has a mandrel 43. Mandrel 43 is axial, tubular, and secures to a body 45 by means of threads 47. Drill pipe secures to the upper and lower ends of mandrel 43.

A plurality of dogs 49 connect the running tool 41 to the internal grooves 21 in outer wellhead housing 15. Dogs 49 are pushed radially outward by means of a cam 51 formed on mandrel 43. Subsequent rotation and upward movement of mandrel 43 allows the dogs 49 to retract to release the running tool 41 from outer wellhead housing 15. A plate 53 mounts to mandrel 43 for contact with the interior of funnel 37 for positive hold down of funnel and sleeve 37 and 33 while running the conductor.

Referring to FIG. 2, running tool 41 has been released and an inner wellhead housing 55 lowered into place. Inner wellhead housing 55 secures to casing (not shown), typically 20 inch diameter, which extends into the well previously drilled with the drill ahead portions of running tool 41 (FIG. 1) or with a conventional drilling technique if a conventional running tool 41 is used as in this embodiment. The funnel 37 guides a conventional bit to drill the hole and the lower end of the casing into the outer wellhead housing 15.

Inner wellhead housing 55 lands in the outer wellhead housing 15. Inner wellhead housing 55 has a plurality of inner running grooves on a profile 57 near its upper end. A running tool 59 secures to profile 57 for lowering the inner wellhead housing 55 in place. Running tool 59 is used for lowering the inner wellhead housing 55 in place as well as cementing.

Running tool 59 has a funnel retriever 61 mounted to it. Funnel retriever 61 is a downward facing cup-shaped member. It has a depending cylindrical sidewall 63. A plurality of latches 65 locate in the inner diameter of sidewall 63 near the lower end. Latches 65 will ratchet past the outer edge of funnel 37 when the funnel retriever 61 is moved downward. When funnel retriever 61 is picked up, latch 65 will engage the recess 39 of funnel 37.

In operation, template 11 will be located on the sea floor. Conductor pipe will be lowered through receptacle 13. The well will be drilled for the reception of the conductor pipe. The outer wellhead housing 15, which is secured to the upper end of the conductor pipe, will land in receptacle 13. The funnel 37 and gimbal 23 will be mounted to the outer wellhead housing 15 at the surface and lowered with the outer wellhead housing 15. Gimbal 23 will land on conical flange 14.

Once the conductor pipe is in place and cemented, the running tool 41 will be manipulated and lowered downward to drill further or released to allow passage of a conventional bit for drilling a hole for the 20-inch casing. Dogs 49 will release the running tool 41 from the outer wellhead housing 15. The funnel 37 and gimbal 23 will remain in place secured to outer wellhead housing 15 by means of the dogs 35 supporting the weight of the conductor on the template receptacle 13.

Then, the 20-inch casing and the inner wellhead housing 55 will be lowered into the well. The funnel 37 guides the bit and lower end of the casing through the outer wellhead housing 15. The inner wellhead housing 55 will land in the outer wellhead housing 15. As it lands, latches 65 of the funnel retriever 61 will snap past the upper edge of funnel 37. Once in place, as shown in FIG. 2, cement will be pumped down the running tool 59. A stinger (not shown) will direct the cement into the annulus surrounding the 20-inch diameter casing.

Once the cement has set, the operator will release the running tool 59 from the inner wellhead housing 55 by rotation of the drill string. Once free, the operator picks up the drill pipe and along with it the running tool 59. The latches 65 will engage the recess 39 to begin pulling the funnel 37 upward. Upward movement of funnel 37 causes the sleeve 33 to move upward. This frees the dogs 35 to retract outward. This releases the tubular member 27 from the outer wellhead housing 15. Continued upward movement will bring this equipment to the surface, bringing along with it the gimbal 23.

Then, the operator may then install a corrosion cap (not shown), using a line. The operator may start several wells in a cluster in this manner. Once several have been drilled in this manner, the operator will then lower a blowout preventer stack (not shown) and connect it to the inner wellhead housing 55. Preferably, a downward facing funnel (not shown) will be mounted to the blowout preventer stack to guide the stack onto the inner wellhead housing 55. The operator will then drill each of the wells to final depth, installing a final string of casing. The blowout preventer stack can be jumped from well to well guided by the guidelineless funnel on the stack without retrieval to surface to reestablish guidelines. Later, once a platform has been positioned, the operator will reenter each, tieback and complete the wells with a surface mounted tree.

The invention has significant advantages. The retrievable funnel allows the installation of the first string of casing without the need for a guide base and the temporary support of the conductor. The funnel eliminates the need for guidelines for stabbing the bit for the first casing string as well as the first casing string. Mounting the gimbal to a latch allows the gimbal to be removed before drilling to total depth, without having to make a special trip. The gimbal is removed along with the funnel by using the running tool for the first string of casing. Weight of the first string of casing will be imposed only on the wellhead housings, not on the template. This allows the use of a lighter template.

While the invention has been shown in only one of its forms, it should be apparent to those skilled in the art that it is not so limited, but is susceptible to various changes without departing from the scope of the invention.

I claim:

1. A method of drilling a subsea well, comprising:
positioning a receptacle on the subsea floor;
mounting a gimbal to a latching mechanism;
mounting an upward facing funnel to the latching mechanism;
latching the latching mechanism, funnel and gimbal to an outer wellhead housing, then lowering the outer wellhead housing and a string of conductor pipe into the receptacle, landing the gimbal on the receptacle and supporting the weight of the conductor temporarily with the gimbal; then
drilling through the conductor pipe to a selected depth; then
lowering an inner wellhead housing and a string of casing through the funnel and landing the inner wellhead housing in the outer wellhead housing; then
cementing the string of casing in place; then
releasing the latching mechanism and retrieving the funnel, latching mechanism and gimbal to the surface, thereby preventing any weight of the conductor pipe and casing from transferring to the receptacle.

2. The method according to claim 1 wherein the outer wellhead housing, latching mechanism, and funnel are lowered simultaneously onto the receptacle by an outer wellhead housing running tool.

3. The method according to claim 2 wherein the outer wellhead housing running tool releasably latches to a bore provided in the outer wellhead housing.

4. The method according to claim 1 wherein the inner wellhead housing is lowered into the outer wellhead housing by an inner wellhead housing running tool.

5. The method according to claim 4 wherein a retrieval mechanism mounts to the inner wellhead housing running tool and simultaneously retrieves the funnel, latching mechanism and gimbal.

6. The method according to claim 5 wherein the retrieval mechanism slides over the exterior of the funnel when the inner wellhead housing running tool is lowering the inner wellhead housing into the outer wellhead housing.

7. A method of drilling a subsea well, comprising:
positioning a receptacle on the subsea floor;
mounting a gimbal to a latching mechanism;
mounting an upward facing funnel to the latching mechanism;
providing an outer wellhead housing running tool and latching the outer wellhead housing running tool to a bore of an outer wellhead housing;
latching the latching mechanism, funnel and gimbal to the outer wellhead housing; then
lowering the outer wellhead housing and a string of conductor pipe into the receptacle simultaneously with the funnel, latching mechanism and gimbal, and landing the gimbal on the receptacle to temporarily support the weight of the conductor pipe on the receptacle; then
drilling through the conductor pipe for a selected depth; then
retrieving the outer wellhead housing running tool;
providing an inner wellhead housing running tool with a funnel retrieval mechanism and securing the inner wellhead housing running tool to an inner wellhead housing, which in turn is secured to a string of casing; then
lowering the string of casing and inner wellhead housing with the inner wellhead housing running tool through the funnel and landing the inner wellhead housing in the outer wellhead housing; then
cementing the inner wellhead housing in place; then
engaging the funnel with the funnel retrieval mechanism, and releasing the latching mechanism and retrieving the funnel, latching mechanism and gimbal simultaneously to the surface while retrieving the inner wellhead housing running tool, the retrieval of the gimbal preventing any weight of the conductor pipe and casing from transferring to the receptacle.

8. A subsea well assembly for placement on a receptacle located on a subsea floor, comprising in combination:
a gimbal having a lower surface for contact with the receptacle;
an outer wellhead housing for reception in the receptacle;
latch means secured to the gimbal for releasably latching the gimbal to the outer wellhead housing;
an upward facing guide funnel secured to the latch means and positioned to locate above an upper end of the outer wellhead housing;
outer wellhead housing running tool means for lowering the outer wellhead housing, gimbal, latch means and funnel simultaneously onto the receptacle, the outer wellhead housing running tool means being retrievable to the surface after the outer wellhead housing is in place;
an inner wellhead housing;
inner wellhead housing running tool means for lowering the inner wellhead housing through into the outer wellhead housing, the inner wellhead housing running tool means being retrievable to the surface after cement has set the inner wellhead housing in place; and
funnel retrieving means mounted to the inner wellhead housing running tool means for retrieving the funnel, latch means and gimbal simultaneously to the surface during the retrieving of the inner wellhead housing running tool.

9. The assembly according to claim 8 wherein the latch means secures to at least one groove provided on the exterior of the outer wellhead housing.

10. The assembly according to claim 8 wherein the latch means comprises:

a tubular member adapted to fit over the exterior of the outer wellhead housing;

a locking member adapted to engage at least one groove provided on the exterior of the outer wellhead housing;

an axially slidable sleeve mounted around the exterior of the tubular member, and movable between a lower position forcing the locking member radially inward into engagement with the groove, and an upper position allowing the locking member to retract from the groove; and the funnel being mounted to the sleeve, so that when the inner wellhead housing running tool means lifts the funnel, the sleeve will move to the upper position.

11. The assembly according to claim 10 wherein the gimbal is secured to the tubular member.

12. The assembly according to claim 8 wherein the inner wellhead housing running tool means comprises:

a body; and means for securing the body to the inner wellhead housing.

13. The assembly according to claim 12 wherein the funnel retrieving means comprises:

a retrieving member mounted to the body of the inner wellhead housing running tool means and extending radially outward and also downward for reception over the funnel; and a latch mounted to the retrieving member for engaging a lower side of the funnel to lift the funnel upon upward movement of the retrieving member.

14. A subsea well assembly for placement on a receptacle located on a subsea floor, comprising in combination:

a gimbal having a lower surface for contact with the receptacle;

an outer wellhead housing for reception in the receptacle, the outer wellhead housing having a bore and at least one groove on its exterior;

latch means secured to the gimbal for releasably latching the gimbal to the exterior of the outer wellhead housing, the latch means having a tubular member that fits over the exterior of the outer wellhead housing, a locking member moveably mounted to the tubular member for engaging the groove, and an axially movable sleeve for moving the locking member between engaged and disengaged positions;

an upward facing guide funnel secured to the sleeve and positioned to locate above an upper end of the outer wellhead housing;

an inner wellhead housing;

inner wellhead housing running tool means adapted to be secured to a tubular string and to the inner wellhead housing for lowering the inner wellhead housing into the outer wellhead housing, the inner wellhead housing running tool means being retrievable to the surface after cement has set the inner wellhead housing in place;

a retrieving member mounted to the inner wellhead housing running tool means and extending radially outward and also downward for reception over the funnel; and a latch mounted to the retrieving member for engaging a lower side of the funnel to lift the funnel upon upward movement of the retrieving member, whereby lifting of the funnel causes upward movement of the sleeve to disengage the locking member from the groove, allowing the funnel, latch means and gimbal to be simultaneously retrieved to the surface during the retrieving of the inner wellhead housing running tool.

15. A subsea well assembly, comprising in combination:

an outer wellhead housing;

an upward facing funnel;

latch means secured to the funnel for releasably latching the funnel to the outer wellhead housing;

an inner wellhead housing;

inner wellhead housing running tool means for lowering the inner wellhead housing through the funnel into the outer wellhead housing, the inner wellhead housing running tool means being retrievable to the surface after cement has set the inner wellhead housing in place; and funnel retrieving means mounted to the inner wellhead housing running tool means for retrieving the funnel and latch means simultaneously to the surface during the retrieving of the inner wellhead housing running tool.

16. The assembly according to claim 15 wherein the latch means secures to at least one groove provided on the exterior of the outer wellhead housing.

17. The assembly according to claim 15 wherein the latch means comprises:

a tubular member adapted to fit over the exterior of the outer wellhead housing;

a locking member adapted to engage at least one groove provided on the exterior of the outer wellhead housing;

an axially slidable sleeve mounted around the exterior of the tubular member, and movable between a lower position forcing the locking member radially inward into engagement with the groove, and an upper position allowing the locking member to retract from the groove; and the funnel being mounted to the sleeve, so that when the inner wellhead housing running tool means lifts the funnel, the sleeve will move to the upper position.

18. The assembly according to claim 15 wherein the inner wellhead housing running tool means comprises:

a body; and means for securing the body to the inner wellhead housing.

19. The assembly according to claim 18 wherein the funnel retrieving means comprises:

a retrieving member mounted to the body of the inner wellhead housing running tool means and extending radially outward and also downward for reception over the funnel; and a latch mounted to the retrieving member for engaging a lower side of the funnel to lift the funnel upon upward movement of the retrieving member.

* * * * *

UNITED STATES PATENT AND TRADEMARK OFFICE

CERTIFICATE OF CORRECTION

PATENT NO. : 5,316,089

DATED : May 31, 1994

INVENTOR(S) : Randolfo M. Fernandez, et al.

It is certified that error appears in the above-indentified patent and that said Letters Patent is hereby corrected as shown below:

On the title page, item [75] Inventors:
Norman Brammer, Fyvie Turiff, Scotland, should be added as co-inventor.

Signed and Sealed this

Twenty-second Day of November, 1994

*Attest:*

Bruce Lehman

BRUCE LEHMAN

*Attesting Officer*

*Commissioner of Patents and Trademarks*